United States Patent [19]

Chiari

[11] 4,050,184

[45] Sept. 27, 1977

[54] MULTI-COMPONENT, SPHERICAL, ASSEMBLABLE TOY

[76] Inventor: Gervasio Chiari, via Antonelli 7, Cologne (BS), Italy

[21] Appl. No.: 676,286

[22] Filed: Apr. 12, 1976

[30] Foreign Application Priority Data

Jan. 28, 1976 Italy ..... 5118/76

[51] Int. Cl.[2] ..... A63H 33/06

[52] U.S. Cl. ..... 46/17; 46/23; 273/157 R; 35/46 A

[58] Field of Search ..... 46/16, 17, 23, 24, 25, 46/26; 35/46 R, 46 A, 72, 73; 273/153 P, 153 R, 156, 157 R

[56] References Cited

U.S. PATENT DOCUMENTS

| | | | |
|---|---|---|---|
| 610,577 | 9/1898 | Baldwin | 35/72 |
| 2,987,318 | 6/1961 | Hammer | 273/157 |
| 3,081,089 | 3/1963 | Gustafson | 273/156 |
| 3,691,704 | 9/1972 | Novak | 52/80 |

*Primary Examiner*—Louis G. Mancene
*Assistant Examiner*—Mickey Yu

[57] ABSTRACT

An assemblable, multi-component, spherical toy is disclosed which comprises an inner supporting structure consisting of a plurality of quadrilateral elements connected to one another by H-shaped couplers, and a plurality of convex quadrilateral cover plates covering the supporting structure.

8 Claims, 8 Drawing Figures

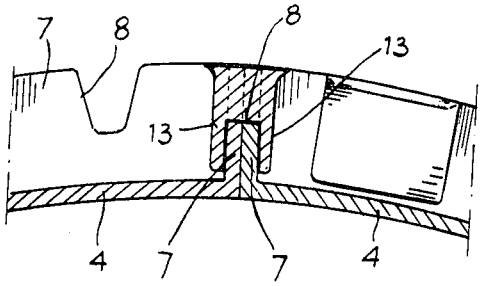
Fig. 5
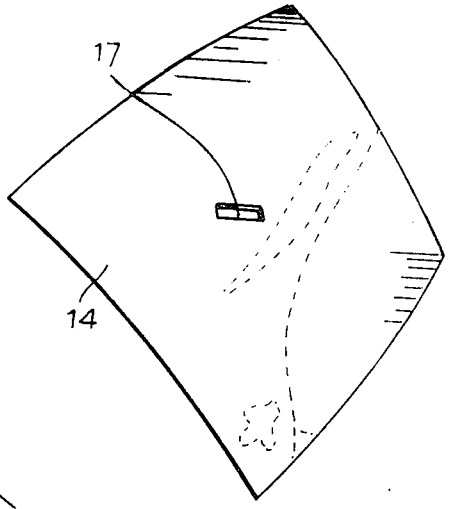
Fig. 6
Fig. 7
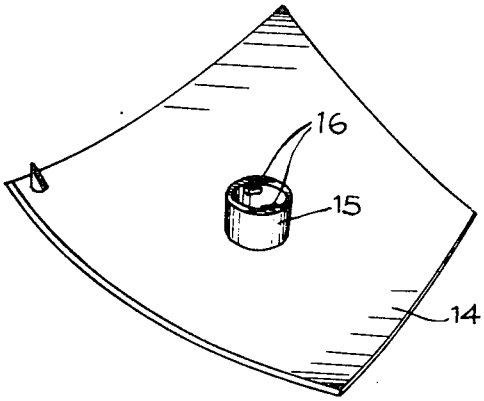
Fig. 8
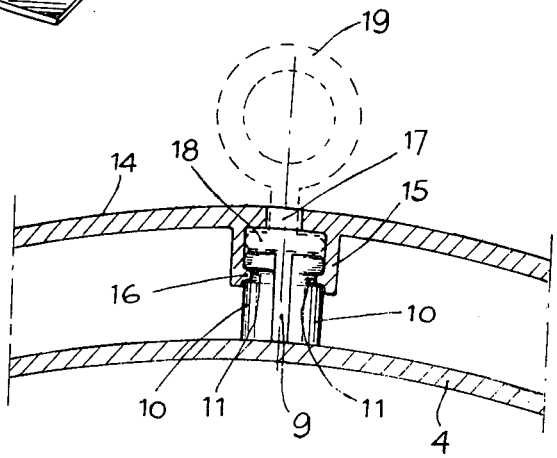

MULTI-COMPONENT, SPHERICAL, ASSEMBLABLE TOY

The present invention relates to a multi-component, spherical, assemblable toy. the spherical structure of the toy comprises an inner and supporting structure and a plurality of surface, interchangeable cover plates.

Present pedagogical doctrines teach the use of preformed articles, toys, etc. having assemblable multi-component structures as the simplest and most suitable way of aiding in the development of the mental, creative and intellectual characteristics of a child of preschooling or elementary school age.

It has been established scientifically that some of the most valuable pedagogical tools are toy articles which are assemblable, disassemblable and structurally interchangeable directly by the child while playing. This gives rise to variations in the structural composition of the toy while concurrently engaging the mental and intellectual capability of the child.

It is the main object of the present invention to achieve the above pedagogical goals by providing a structurally designed toy capable of engaging the child both physically and mentally and thus developing the rational characteristics of his intellect.

It is another object of the invention to provide a toy, the assembling of the components of which may be entrusted directly to the child thus allowing his ingenuity and dexterity to freely express themselves to the largest extent possible. This is partially due to the fact that, preferably, each component surface plate bears thereon visual reproductions having not only playful but also educational significance.

Briefly stated, the toy of the invention comprises a supporting spherical structure consisting of a plurality of quadrilateral elements connected to one another and assembled into a single entity by means of connecting couplers; and consisting further of a plurality of surface cover plates, similarly of quadrilateral configuration and capable of being snap-connected onto the said supporting structure. Each plate bears a whole or part of a design or figure or illustration forming, together with all other plates an educational composite.

The invention will be understood more fully from the following details of the embodiments thereof, with reference to the accompanying drawings in which:

FIG. 5 is a sectional view of the assembly of two elements of the supporting structure;

FIGS. 6 and 7 are top and bottom perspective views, respectively, of a surface cover plate; and FIG. 8 is a partial sectional view of a cover plate assembled onto the supporting inner structure, and shows in phantom a typical key for the ready assemblage of the cover plate.

Figure 2:
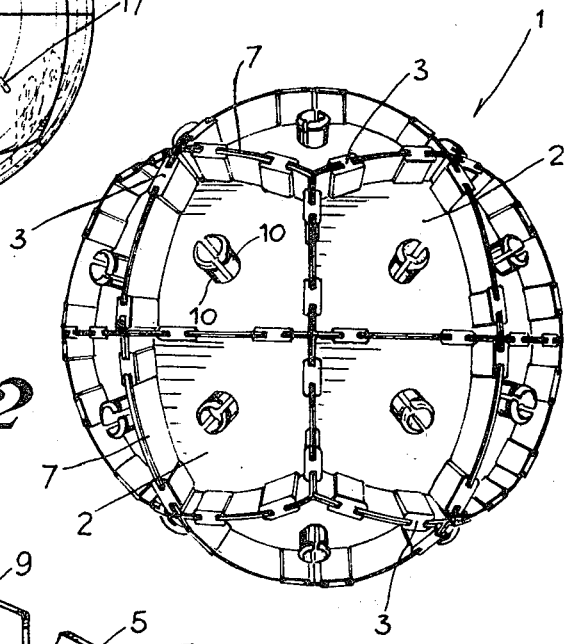
FIG. 2 is a perspective view of the supporting, inner, spherical structure.
Figure 3:
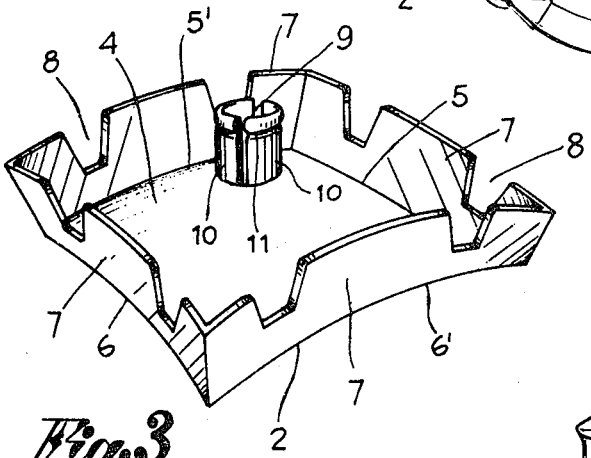
FIG. 3 is a perspective view of a coupler for the assembly of the supporting structure of FIG. 2.

Referring now to the accompanying drawings, the toy of the invention comprises a supporting spherical body or structure, indicated generally at 1 in FIG. 2, which structure is in turn comprised of a plurality of elements 2, dimensionally equal to one another and connected to one another by means of couplers 3. Each element 2 — see FIG. 3 — comprises a portion with convex surface 4 of irregular quadrilateral shape and having two adjacent sides 5, 5' equal to each other and facing two other sides 6, 6', similarly adjacent and equal to each other.

All four sides 5, 5', 6 and 6' are connected by an edge 7 which is provided with a plurality of V-shaped notches 8, and is positioned upwardly from the convex surface 4 of the element 2. Further, substantially in the center of the convex surface 4 there is provided a protruding bushing 9 having substantially diametrical longitudinal cuts therein. These cuts define a pair of relatively flexible semicylindrical portions 10, each of which is provided with an outer peripherical throat 11, the function of which will be explained hereinlater — see also FIG. 8.

Figure 4:
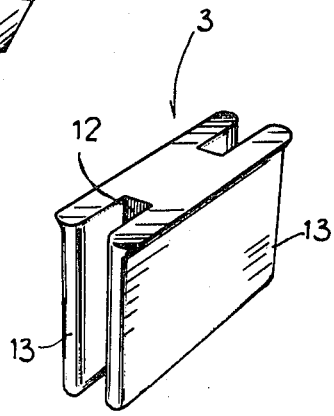
FIG. 4 is an enlarged perspective view of a typical assembly of a coupler for the supporting structure.

The coupler 3 which serves to connect the individual elements 2 in the construction of the spherical supporting structure comprises a substantially H-shaped configuration — see FIG. 4 — the central transverse part 12 of which connects the two opposed wings 13 and has shape and height corresponding to the shape and height of the notches 8 provided in the peripherical edges 7 of element 2 — see FIG. 5.

In order to assemble the elements 2 of the structure, these are placed one adjacent to another so that two of their equal sides are abutting each other. Next, the H-shaped couplers 3 are fitted in the notches 8 of the abutting sides. This will firmly connect the two elements in question. This operation is repeated again and again, abutting one element 2 after another and connecting it by means of couplers. A simplified method of assembling the supporting structure consists of assembling elements together in groups of three and then assembling one trio to another.

Figure 1:
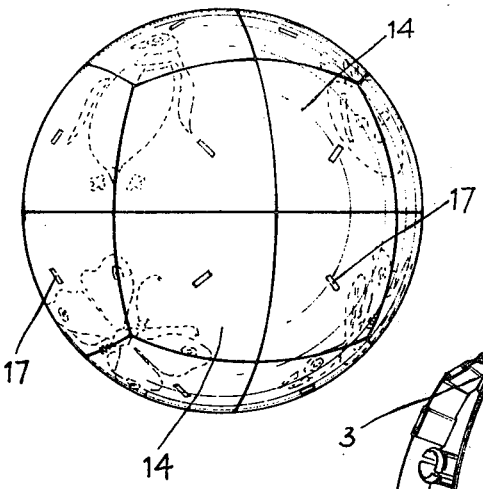
FIG. 1 is a perspective view of a finished toy.

When the spherical supporting structure 1 is assembled, the cover plates 14 are connected thereto; arranging them in such a way as to match the various designs depicted thereon. Each individual cover plate 14 has dimensions which correspond to those of the element 2 of the supporting structure 1. The surface of each plate is convex so that, when the entire plurality of plates is assembled, a spherical configuration is obtained as shown in FIG. 1.

The cover plates 14, as shown in the drawings, are provided on their inner surface with a bushing member 15 which is so shaped that it may receive therein the bushing formed by the two flexible portions 10 of the elements 2. Within the bushing 15 there are provided two tappets 16 opposed to each other and serving the purpose of engaging by snap action the peripherical throats 11 of the flexible parts 10. This arrangement insures the rigid connection of the plate 14 — see FIG. 8.

To assemble a plate, the flexibility of portions 10 is exploited. Conversely, to disassemble a plate or to interchange plates, there is provided in alignment with bushing 15 a slit 17 through which the T-shaped extremity 18 of a key 19 may be introduced, By turning the key and pulling, it is possible to detach the bushing 15 of the plate 14 from the bushing 9 of the corresponding element 2.

Thus, the assembly of the spherical support body, followed by the correct positioning of the various cover plates, are such as to engage the attention, curiosity and ingenuity of a child and to assist considerably in the development of his intellectual capability.

It is to be understood that many variations and modifications may be had with respect to the various elements of the toy without departing from the scope of the invention.

What is claimed is:

1. An assemblable, multi-component, spherical toy comprising a supporting inner structure consisting of a plurality of quadrilateral elements and a plurality of couplers connecting said elements to one another, and a plurality of quadrilateral cover plates connectable removably onto said elements of said supporting structure, said quadrilateral elements comprising a convex plate having two first adjoining sides equal to each other and two second adjoining sides equal to each other, an edge upwardly extending all around said plate, and a plurality of V-shaped notches in said edge.

2. The toy of claim 1, wherein said plates have on the outer surface thereof at least a portion of a design.

3. The toy of claim 1, wherein said coupler is H-shaped having a central transverse section for engaging into the V-shaped notches of said edge, and having opposed wings for engaging and holding therebetween the edges of two abutting elements of the supporting structure.

4. The toy of claim 1, wherein said element has a substantially central bushing and said cover plate has also a bushing thereon for juxtaposed connection with the said busing of said element.

5. The toy of claim 1, wherein said cover plate is convex, quadrilaterally-shaped and has a connecting bushing on one side thereof.

6. The toy of claim 4 wherein said bushing of said element has two longitudinal slots therein which define a pair of flexible portions, said portions having an outer peripherical throat thereon; and wherein said bushing of said cover plate is fit to receive therein said bushing of said element, said bushing of said cover plate having a pair of opposite tappets on the inner surface thereof to serve as retaining means against the said throats.

7. The toy of claim 4, wherein said cover plate has in alignment with said bushing and on the opposite surface thereto an opening for the purpose of allowing the passage therethrough of means for disassembling said toy.

8. The toy of claim 7, wherein said means is a key with a T-shaped extremity for insertion into said opening.

* * * * *